US006945690B2

(12) United States Patent
Armendariz et al.

(10) Patent No.: US 6,945,690 B2
(45) Date of Patent: Sep. 20, 2005

(54) SYSTEM FOR HOLDING PAINT CONTAINER

(75) Inventors: Adam Armendariz, Buena Park, CA (US); David Armendariz, Lakewood, CA (US); John A. Heiser, Rancho Santa Margarita, CA (US); Christopher E. Jones, Del Mar, CA (US)

(73) Assignee: Masterchem Industries, Inc., Imperial, MO (US)

( * ) Notice: Subject to any disclaimer, the term of this patent is extended or adjusted under 35 U.S.C. 154(b) by 79 days.

(21) Appl. No.: 10/448,023

(22) Filed: May 29, 2003

(65) Prior Publication Data

US 2004/0240314 A1 Dec. 2, 2004

(51) Int. Cl.[7] ..... B01F 9/00; B01F 11/00; B01F 15/00

(52) U.S. Cl. ..... 366/209; 366/214; 366/218; 366/605

(58) Field of Search ..... 366/110, 111, 366/208, 209, 210, 211, 212, 213, 214, 215, 216, 217, 218, 605, 219, 220, 235, 197, 204

(56) References Cited

U.S. PATENT DOCUMENTS

| | | | | |
|---|---|---|---|---|
| 303,080 A | | 8/1884 | Weissenborn | |
| 377,315 A | | 1/1888 | Mains | |
| 406,321 A | | 7/1889 | Wiedersheim | |
| 424,438 A | | 3/1890 | Stubbs | |
| 766,483 A | | 8/1904 | Wolfe | |
| 1,018,947 A | | 2/1912 | Wall | |
| 1,365,963 A | | 1/1921 | Brown et al. | |
| 1,429,652 A | | 9/1922 | Small | |
| 1,448,446 A | | 3/1923 | Hulbert | |
| 1,619,526 A | * | 3/1927 | Meeker et al. | 366/208 |
| 1,688,665 A | * | 10/1928 | Smellie | 366/211 |
| 1,755,763 A | | 4/1930 | Barber | |
| 1,947,398 A | | 2/1934 | Stuhler | |
| 2,006,451 A | | 7/1935 | Glidden | 91/57 |
| 2,022,527 A | | 11/1935 | Schletz | |
| 2,060,932 A | | 11/1936 | Friermood | |
| 2,082,593 A | | 7/1937 | Pankotan | |
| 2,228,765 A | | 1/1941 | Jerwan | |
| 2,374,430 A | | 4/1945 | Hexter | 249/14 |
| 2,494,866 A | | 1/1950 | Fressola | 95/99 |
| 2,599,852 A | * | 6/1952 | McClain | 366/208 |
| 2,671,648 A | | 3/1954 | Kost | |
| 2,787,402 A | | 4/1957 | Stiner et al. | 222/76 |
| 2,797,902 A | | 7/1957 | Buegler | 259/72 |
| 2,848,019 A | | 8/1958 | Corbin et al. | 141/100 |
| 2,868,519 A | * | 1/1959 | Tocci | 366/209 |
| 2,894,309 A | | 7/1959 | Brzowski | 24/263 |
| 2,915,640 A | | 12/1959 | Grubel et al. | 250/108 |

(Continued)

FOREIGN PATENT DOCUMENTS

| | | |
|---|---|---|
| JP | 59-135126 | 8/1984 |
| JP | 61-167929 | 7/1986 |
| JP | 2-307523 | 12/1990 |
| JP | 8-309173 | 11/1996 |
| JP | 11-226375 | 8/1999 |
| JP | 2002-79166 | 3/2002 |
| JP | 2002-346358 | 12/2002 |
| WO | WO 03/031041 | 4/2003 |

*Primary Examiner*—Tony G. Soohoo
(74) *Attorney, Agent, or Firm*—Foley & Lardner LLP

(57) ABSTRACT

A holder for mixing a container of paint is disclosed. The system comprising a body having a cover and a base. The system also comprises an aperture in the cover of the body. The system also comprises a cavity in the body and accessible through the aperture and configured to receive the container. The density of the body corresponds to the density of the container of paint. A system for holding and mixing a container of paint having a lid secured to a first body is also disclosed. A system for holding and mixing a first container of paint having a first volume and a second container of paint having a second volume less than the first volume is also disclosed.

29 Claims, 12 Drawing Sheets

U.S. PATENT DOCUMENTS 3,015,415 A 1/1962 Marsh et al. ..... 222/14
3,018,092 A 1/1962 Johnson
3,066,830 A 12/1962 Heiss et al. ..... 222/135
3,074,597 A 1/1963 Felts ..... 222/43
3,090,604 A 5/1963 Wheeler
3,115,905 A 12/1963 Lau ..... 141/76
3,122,272 A 2/1964 Marsh ..... 222/26
3,173,352 A 3/1965 Lane
3,176,967 A 4/1965 Hartley
3,281,125 A 10/1966 Shoe et al.
3,284,057 A 11/1966 Duquette
3,301,534 A 1/1967 Orser
3,374,584 A 3/1968 Haught
3,480,259 A 11/1969 Schletz
3,499,068 A 3/1970 Brown ..... 264/68
3,539,156 A 11/1970 Zipperer
3,542,344 A 11/1970 Oberhauser
3,735,962 A 5/1973 Pagano
3,735,964 A 5/1973 Lorenzen
3,880,408 A 4/1975 Karjalainen
3,885,357 A * 5/1975 Hoyt ..... 366/209
3,998,434 A 12/1976 Gaynor
4,004,783 A 1/1977 Wilson
4,090,612 A 5/1978 Lostutter
4,114,196 A 9/1978 Lostutter ..... 366/348
4,118,801 A 10/1978 Kraft et al. ..... 366/111
4,198,166 A 4/1980 Tuns ..... 366/112
4,235,553 A * 11/1980 Gall ..... 366/208
4,265,548 A 5/1981 Hall ..... 366/208
4,281,936 A 8/1981 Schotter et al. ..... 366/209
4,329,068 A 5/1982 Neuner et al. ..... 336/214
4,335,759 A 6/1982 Pattiniemi et al. ..... 141/5
4,398,829 A 8/1983 Shick ..... 366/110
4,445,782 A 5/1984 Sparrow, Jr. ..... 366/217
4,468,129 A 9/1984 McIntosh et al.
4,497,581 A * 2/1985 Miller ..... 366/208
4,568,194 A 2/1986 Gargioni ..... 366/213
4,588,302 A 5/1986 Pizzi et al. ..... 366/349
4,683,706 A 8/1987 Harper ..... 53/485
4,702,610 A 10/1987 Reynolds, Jr. ..... 366/213
4,705,083 A 11/1987 Rossetti ..... 141/104
4,747,693 A 5/1988 Kahl ..... 366/208
4,784,297 A 11/1988 Katz ..... 222/161
4,788,438 A 11/1988 Evers ..... 250/506.1
4,789,245 A 12/1988 Morbeck ..... 366/217
4,813,785 A 3/1989 Miller ..... 366/251
4,842,415 A 6/1989 Cane et al. ..... 366/110
4,890,931 A * 1/1990 Herold ..... 366/209
4,922,688 A 5/1990 Langen et al. ..... 53/525
4,967,938 A 11/1990 Hellenberg ..... 222/144
5,050,996 A 9/1991 Allen ..... 366/211
5,167,448 A * 12/1992 Herold et al. ..... 366/213
5,197,802 A 3/1993 Miller et al. ..... 366/217
5,215,195 A 6/1993 Williams ..... 206/446
5,261,744 A 11/1993 Brunn
5,268,620 A 12/1993 Hellenberg ..... 318/114
5,322,358 A * 6/1994 Coho et al. ..... 366/214
5,352,037 A * 10/1994 Jouvin ..... 366/219
5,372,425 A 12/1994 Tannenbaum et al. ..... 366/208
5,383,163 A 1/1995 Brunn ..... 366/217
5,399,013 A * 3/1995 Sawyer ..... 366/211
5,439,287 A 8/1995 Roepke, Sr. ..... 366/130
5,443,314 A 8/1995 Gatlin ..... 366/215
5,458,416 A 10/1995 Edwards et al. ..... 366/209
5,462,353 A 10/1995 Gatlin ..... 366/209
5,468,068 A 11/1995 Hotchkiss, III ..... 366/348
5,474,211 A 12/1995 Hellenberg ..... 222/1
5,493,840 A 2/1996 Cane ..... 53/50
5,507,574 A 4/1996 Dickey ..... 366/213
5,507,575 A 4/1996 Rossetti ..... 366/217
5,551,779 A * 9/1996 Gantner et al. ..... 366/217
5,662,416 A 9/1997 Dwigans, II ..... 366/209
5,697,703 A 12/1997 Lucchetti ..... 366/198
5,704,711 A 1/1998 Simmons ..... 366/199
5,711,601 A 1/1998 Thomas et al. ..... 366/209
5,746,510 A * 5/1998 Mark et al. ..... 366/217
5,749,652 A 5/1998 Brunn et al.
5,788,371 A * 8/1998 Neri et al. ..... 366/217
5,833,362 A 11/1998 Shepard ..... 366/111
5,906,433 A 5/1999 Mazzalveri ..... 366/209
6,050,719 A 4/2000 Winkler et al. ..... 366/144
6,193,410 B1 2/2001 Puckett, II ..... 366/348
6,302,575 B1 10/2001 Anderson et al. ..... 366/349
6,508,582 B2 1/2003 Friedman ..... 366/110
6,517,230 B1 2/2003 Afnan et al. ..... 366/142
6,582,117 B2 * 6/2003 Rogers et al. ..... 366/605
6,612,732 B2 * 9/2003 Blakeman et al. ..... 366/209
6,767,125 B2 * 7/2004 Midas et al. ..... 366/209
6,817,751 B2 * 11/2004 Huckby et al. ..... 366/217
2003/0076738 A1 * 4/2003 Blakeman et al. ..... 366/209
2003/0102339 A1 6/2003 Walsh et al. ..... 222/567
2003/0102340 A1 6/2003 Walsh et al. ..... 222/572
2003/0107949 A1 6/2003 Huckby et al. ..... 366/217
2003/0121941 A1 7/2003 Walsh et al. ..... 222/465.1
2003/0142583 A1 * 7/2003 Santospago et al. ..... 366/209
2003/0214878 A1 * 11/2003 Huckby ..... 366/217
2004/0085855 A1 * 5/2004 Midas et al. ..... 366/209

* cited by examiner

SYSTEM FOR HOLDING PAINT CONTAINER

CROSS-REFERENCE TO RELATED PATENT APPLICATIONS

The following U.S. patent applications are cited by reference and incorporated by reference herein: U.S. patent application Ser. No. 10/419,054 titled "SYSTEM FOR HOLDING PAINT CONTAINER" filed Apr. 18, 2003, U.S. Design patent application No. 29/164,453 titled "CONTAINER" filed Jul. 24, 2002, U.S. patent application Ser. No. 10/265,564 titled "CONTAINER" filed Sep. 25, 2002, which is a continuation-in-part of U.S. patent application Ser. No. 10/132,682 titled "CONTAINER" filed Apr. 25, 2002, which is a continuation-in-part of U.S. patent application Ser. No. 10/006,985 titled "PAINT CONTAINER" filed Dec. 5, 2001.

FIELD

The present invention relates generally to the field of systems for holding paint containers and more particularly to an adapter for use with an orbital or rotary shaker.

BACKGROUND OF THE INVENTION

Paint shakers are used to mix paint prior to sale of the paint and/or prior to use to ensure a homogenous mixture of the paint components that may have separated. Additionally, paint shakers are used to thoroughly mix a tint or colorant to the paint to add and/or change the color of the paint.

One apparatus used for shaking paint employs a top plate and a bottom plate that is moved toward and compresses the paint container between the plates. The plates then move in unison in an up and down direction to thoroughly mix the paint. When a color additive is added to the container by first removing the lid, the compression of the two plates ensures that the paint container lid or cap remains secured to the container body. In this way, no paint can be spilled from the container as the container is moved up and down. The plates move up and down relative to one another along a vector that is perpendicular to both of the plates. The top plate is moved up sufficient to allow the paint container to be removed. Typically, the container is loaded into the shaker between the top and bottom plates in a direction that is parallel to the two planes defined by the top and bottom plates.

A second type of apparatus is a shaker (commonly referred to as a "vortex" or rotary or orbital shaker) that moves the container along one axis in one path (e.g. rotary) to mix the paint, and along another axis in another path (e.g. orbital) to mix the paint. In this type of shaker (referred to in this disclosure as an orbital and/or rotary shaker), the container is not moved up and down but rather in an orbital or rotary path. Examples of this type of shaker include the Model No. 5600 AutoSperse Paint Shaker and the Model No. 5610 AutoSperse Paint Shaker, both commercially available from Red Devil Equipment Company of Brooklyn Park, Minn. In this type of shaker, the paint container is typically loaded into a bucket or holder that has a top opening and a cavity to receive the paint container. In contrast to the compression mixers discussed above, the bucket or holder holds the container in place. Since the paint container is not shaken in an up down direction, the paint container need not be clamped in the up/down direction. This type of shaker allows for easy insertion and removal of the paint container by simply placing the paint container within the open end of the bucket or holder. If the cap or lid of the paint container is not securely fixed to the body of the paint container, it is possible that paint will leak out of the cap during the rotary motion of the container.

Such known shakers are typically configured for use with a single sized container of paint, such as a one-gallon container of paint. However, such known shakers are not well adapted for use with other sized containers of paint, such as a one-quart container of paint.

It is known to use an adapter with such known shakers for use with multiple sized containers of paint (e.g. one-gallon and one-quart). Such known adapters are typically configured for use with conventional containers of paint having a circular perimeter. However, such known adapters may result in an unbalanced or inadequate mixing of the paint and are not configured for use with containers of paint having other perimeters (e.g. "D"-shaped).

It would be desirable to provide a system for holding a paint container in a paint shaker that permits for mixing of multiple sized containers of paint. It would also be desirable to combine the benefit of the rotary and/or orbital motion of the rotary and/or orbital shaker with the benefit of a compression clamp to ensure that the paint container does not leak during the rotary or orbital motion. It would also be desirable to provide a system for holding a paint container in a paint shaker that provides for balanced and thorough mixing of the paint. It would further be desirable to a system for holding a paint container in a paint shaker that is relatively easy to use by a retail store operator. It would still further be desirable to a system for holding a paint container in a paint shaker having one or more of these or other advantageous features.

SUMMARY OF THE INVENTION

The present invention relates to a holder for mixing a container of paint. The system comprises a body having a cover and a base. The system also comprises an aperture in the cover of the body. The system also comprises a cavity in the body and accessible through the aperture and configured to receive the container. The density of the body corresponds to the density of the container of paint.

The present invention also relates to a system for holding and mixing a container of paint having a lid secured to a first body. The system comprises a holder comprising a clamp having a plate configured to apply pressure to the lid of the container. The system also comprises a motor configured to move the holder about at least one axis. The system also comprises an adapter comprising a second body configured to nest in the holder and a cavity in the second body configured to receive the container. The system also comprises an aperture in the adapter positioned off-center from a central vertical axis of the body. The density of the adapter corresponds to the density of the container of paint.

The present invention also relates to a system for holding and mixing a first container of paint having a first volume and a second container of paint having a second volume less than the first volume. The system comprises a holder configured to hold the first container. The system also comprises an adapter configured for being removably placed within the holder and being configured to support the second container. The adapter has substantially the same mass distribution as the first container.

It is important to note that the term "paint" as used in this disclosure is intended to be a broad term and not a term of limitation. The term "paint" as used in this disclosure may include, without limitation any liquid dispersion, finishes, surface finishes, varnishes, pigments, colorants, other coatings, etc.

BRIEF DESCRIPTION OF THE DRAWINGS

FIG. 6A is a top plan view of an adapter for the paint shaking system of FIG. 5 with a paint container of FIG. 5 according to a preferred embodiment.

DETAILED DESCRIPTION OF THE PREFERRED EMBODIMENTS

Figure 1:
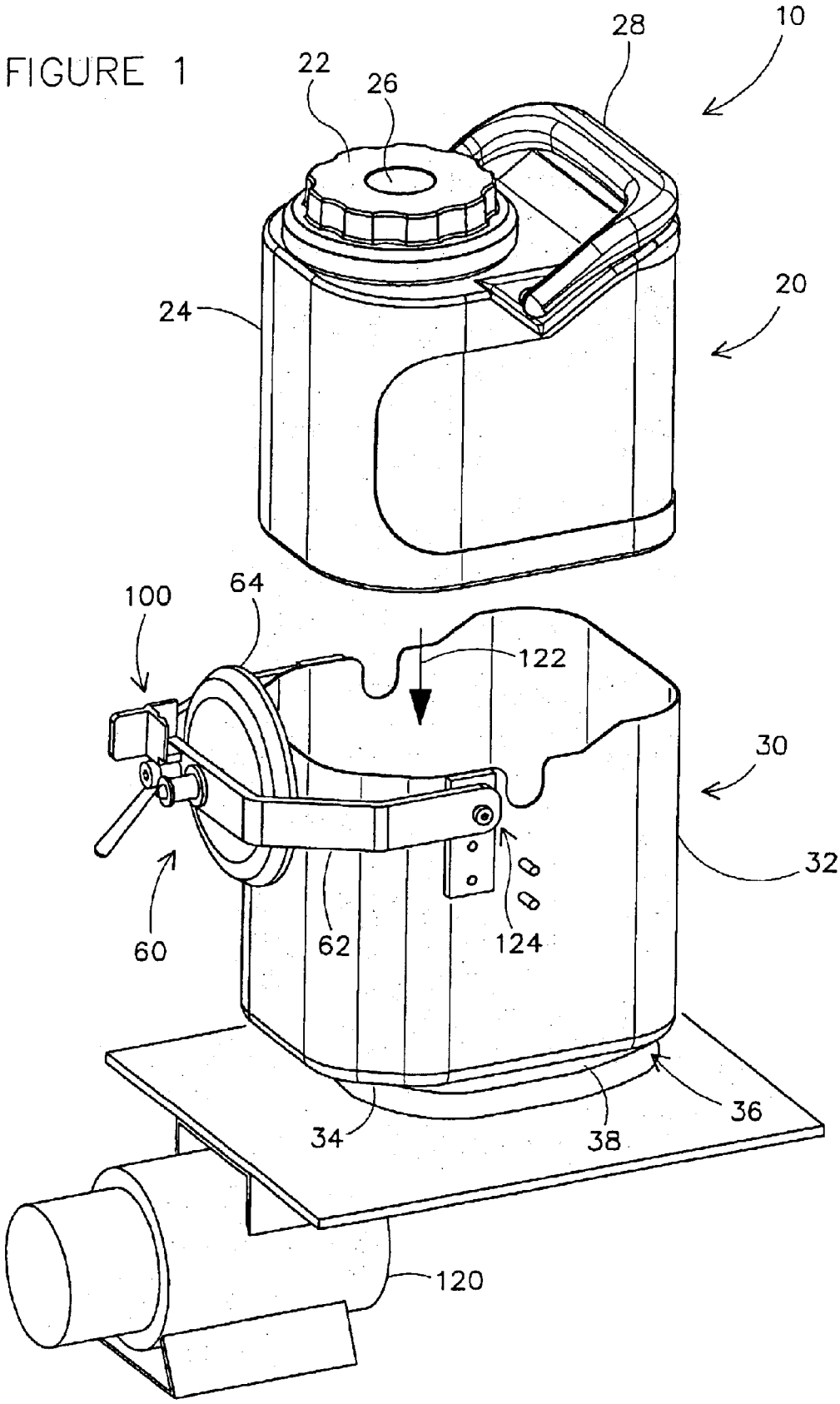
FIG. 1 is an exploded perspective view of a paint shaker system according to a preferred embodiment.

A paint shaker system 10 is shown in FIG. 1 according to a preferred embodiment. System 10 includes a container 20 for storing a fluid dispersion such as paint. System 10 also includes a mixer or shaker 30 having a receptacle bucket or holder 32 for receiving container 20. An adapter or clamp assembly 60 of holder 32 is configured to stabilize and maintain the position of container 20 during shaking and mixing action provided by a motor 120 (shown schematically in FIG. 1). According to a particularly preferred embodiment, the shaker is a Model No. 5300 Speed Demon Vortex Mixer (bucket design) commercially available from Red Devil Equipment Company of Brooklyn Park, Minn. A base 34 of holder 32 includes a registration mechanism 36 (such as an indentation) for registering and aligning the position of a body 24 of container 20. The registration mechanism (shown as a protrusion 38 in FIG. 1) may also register the position of holder 32 relative to motor 120. The registration mechanism may also include a mounting interface (such as a pin) according to an alternative embodiment.

The loading and retention of container 20 in holder 32 is shown in FIGS. 2A through 2E according to an exemplary embodiment. Container 20 is "dropped" or loaded into holder 32 from an overhead position along a vector 122 using a bail or handle 28 according to a preferred embodiment (see FIG. 1).

Figure 2A:
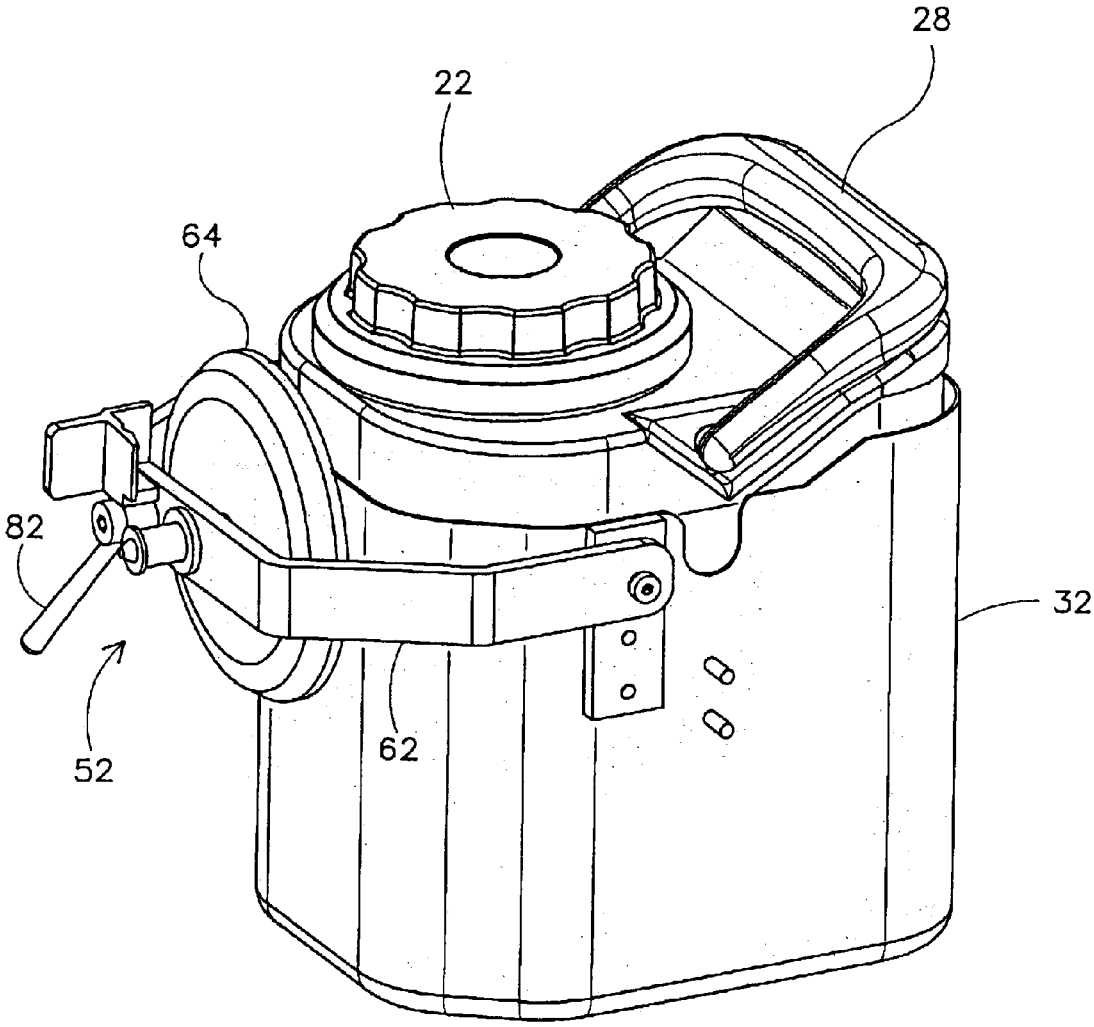
FIGS. 2A through 2E are perspective views of the paint shaker system of FIG. 1 shown locking a paint container according to an exemplary embodiment.
Figure 2B:
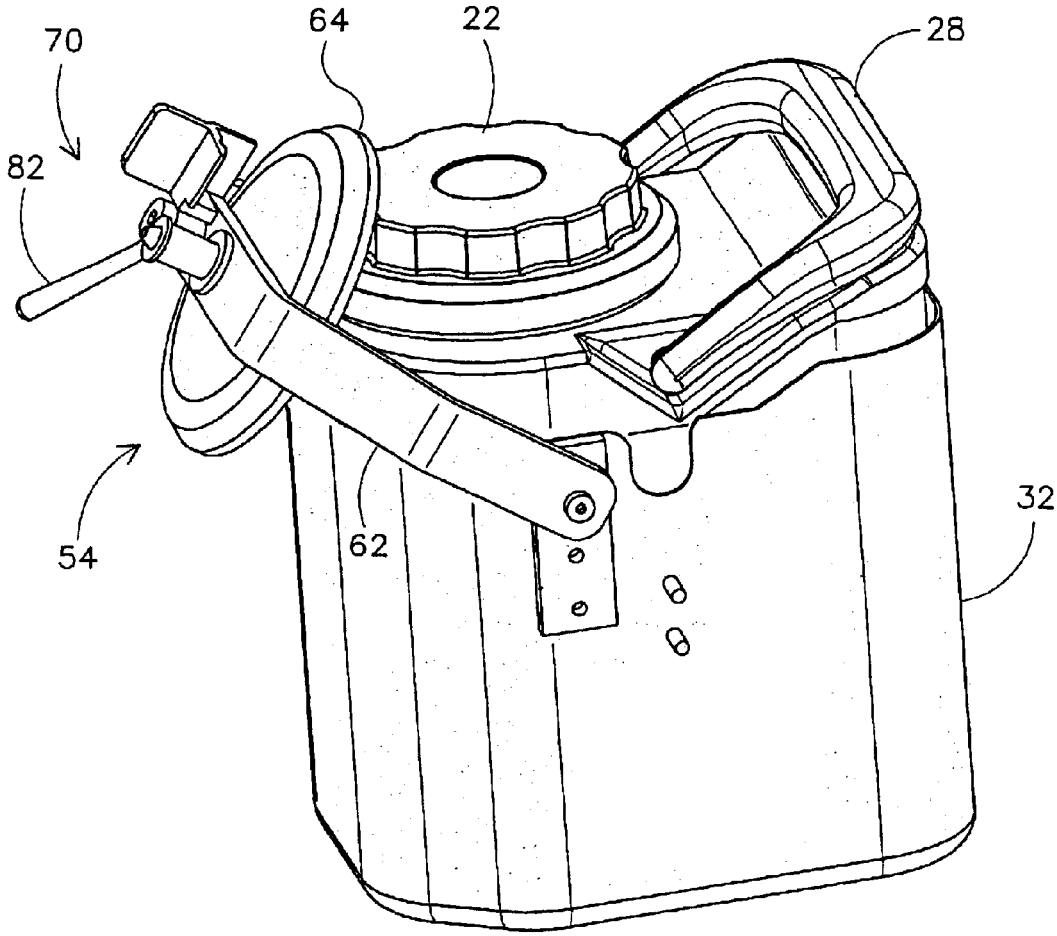
Figure 2C:
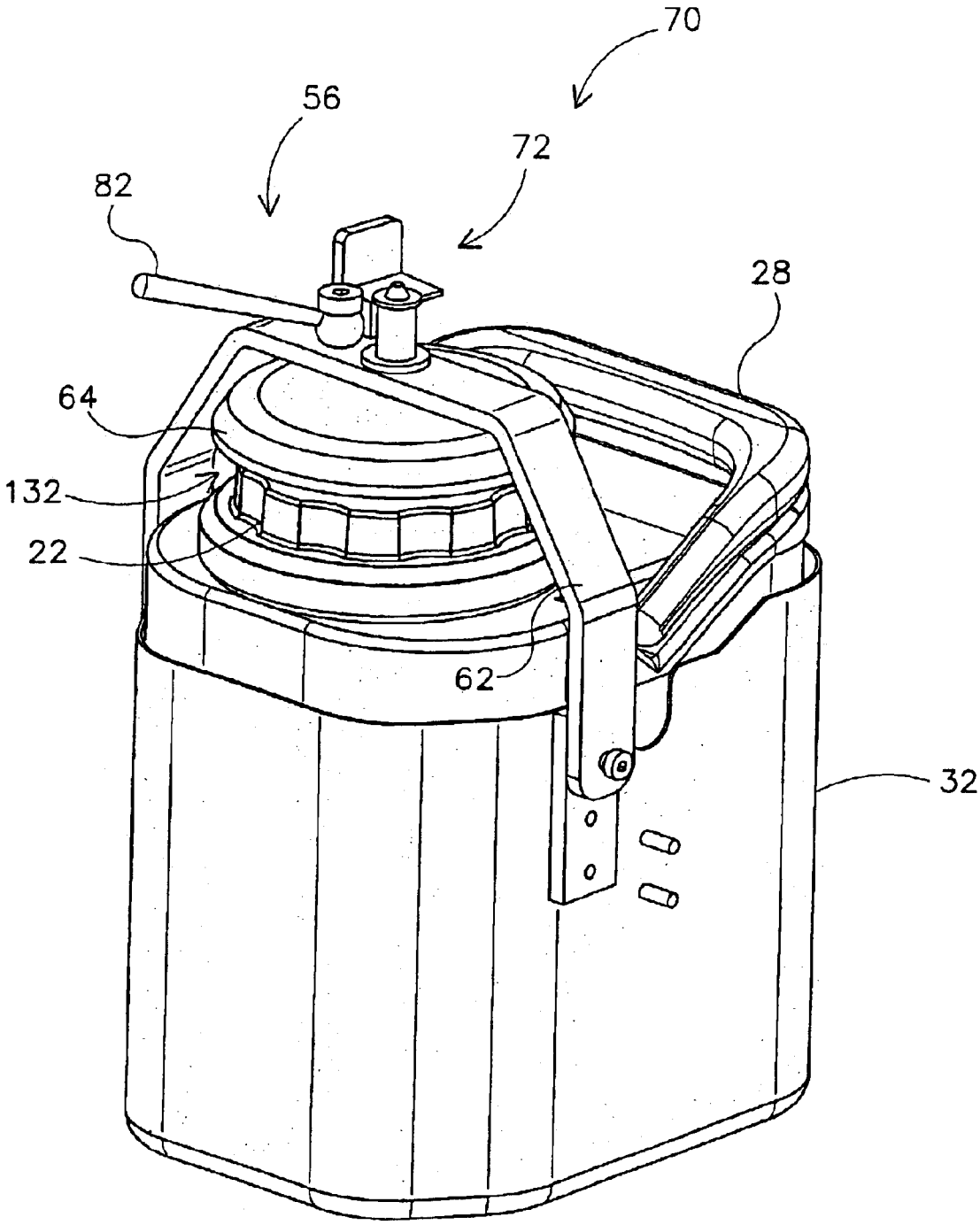

The pivoting of clamp assembly 60 through an opened or retracted position 52 and a closed or advanced "use" position 56 is shown in FIGS. 2A through 2C. A substantially "U"-shaped swing arm 62 of clamp assembly 60 is attached to a side wall of holder 30 by a hinge or pin 124 according to a preferred embodiment as shown in FIG. 1.

Clamp assembly 60 is shown in FIG. 2A in retracted position 52 (e.g. after loading of container 20 in holder 30). A compression jaw or pressure plate 64 is drawn over a cap or lid 22 of container 20 as clamp assembly 60 is moved to a partially retracted position 54 as shown in FIG. 2B. FIG. 2C shows clamp assembly 60 in advanced position 56, a locking mechanism 70 in an uncompressed or unlocked position 72, and plate 64 spaced above lid 22 of container 20. A gap 132 is provided between plate 64 and lid 22 when locking mechanism 70 is in unlocked position 72 as shown in FIG. 2C (see also FIG. 4A).

Figure 2D:
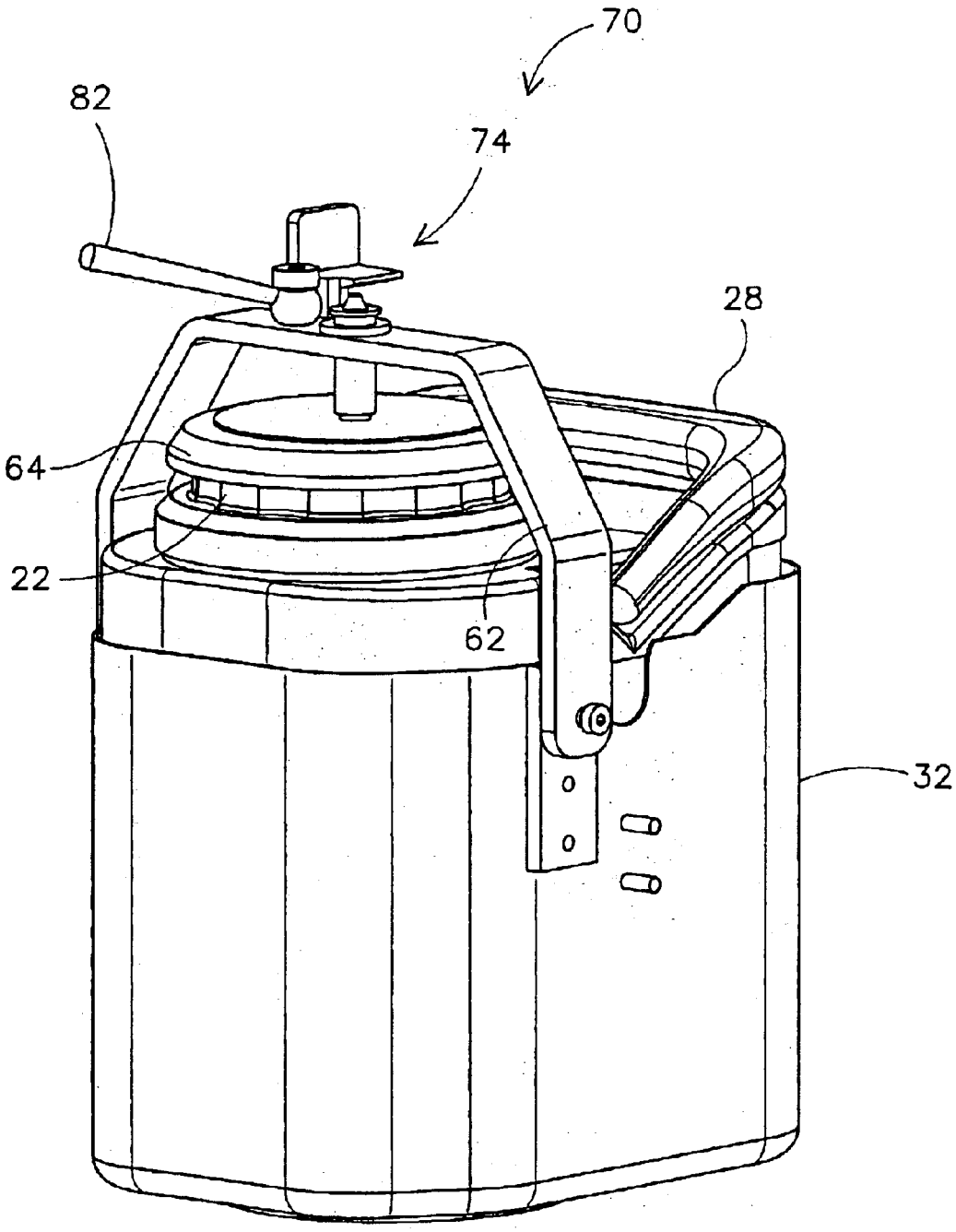
Figure 4A:
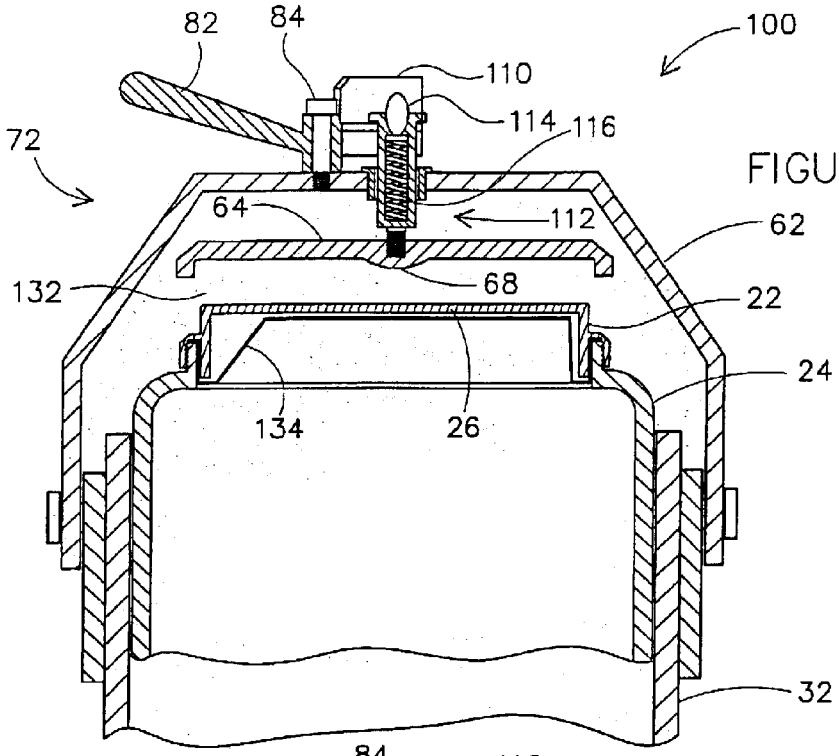
FIG. 4A is a sectional view of the clamp assembly of FIG. 3 showing a clamp in an unlocked position.
Figure 4B:
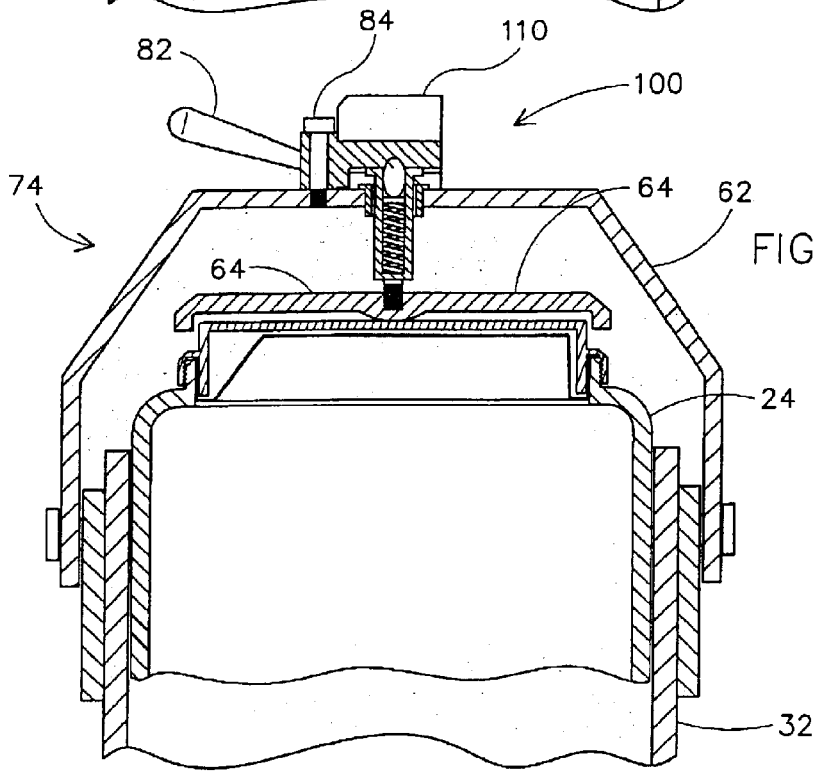
FIG. 4B is a sectional view of the clamp assembly of FIG. 3 showing the clamp in an intermediate position.

Plate 64 is moved from unlocked position 72 to a temporary or intermediate position 74 in which plate 64 "floats" or is driven downwardly to engage lid 22 and substantially eliminate gap 132 as shown in FIG. 2D (see also FIG. 4B). The turning of a handle assembly 80 moves locking mechanism 70 vertically relative to arm 62 from unlocked position 72 (see FIGS. 2D and 4A) to a compressed or locked position 76 (see FIGS. 2E and 4C) according to an exemplary embodiment.

Figure 4C:
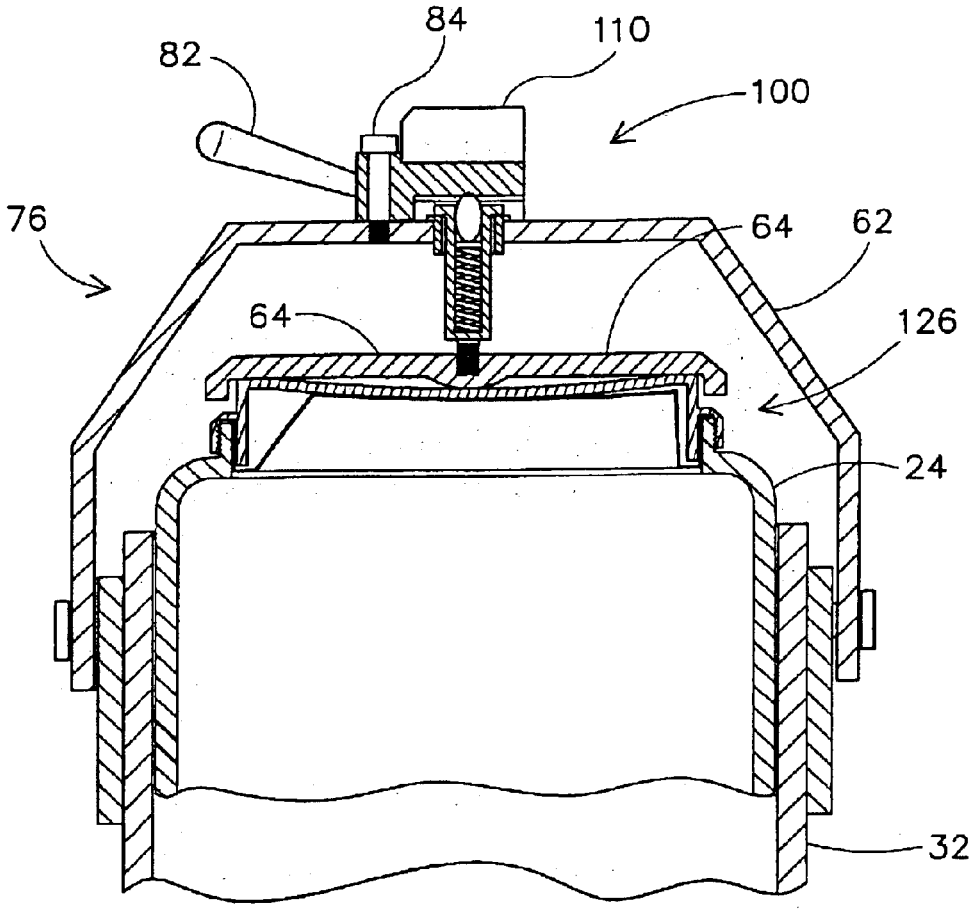
FIG. 4C is a sectional view of the locking mechanism of FIG. 3 showing the clamp in a locked position.

In intermediate position 74, a protrusion or bump 68 of plate 64 makes initial contact with a center 26 of lid 22. In locked position 76, plate 64 applies a downward vertical force to lid 22 (including a peripheral edge 126 of lid 22) to inhibit leakage of the contents of container 20 as shown in FIG. 4C. Bump 68 deflects lid 22 (which may include a convex or concave crown according to alternative embodiments) when clamp assembly 60 is in locked position 76 as shown in FIG. 4C according to a preferred embodiment. According to a preferred embodiment as shown in FIG. 1, center 26 of lid 22 is off-center from the center of base 34 of holder 30 (e.g. situated away from a central vertical axis of the body of the holder).

According to a particularly preferred embodiment, the protrusion has a height of about three-sixteenths of an inch, and a height of about two-sixteenths of an inch according to an alternative embodiment. According to a preferred embodiment, the center of the lid is compressed or deflected downwardly about four-sixteenths of an inch, and the periphery of the lid is compressed or deflected downwardly about two-sixteenths of an inch, when the clamp assembly is in the locked position. According to a particularly preferred embodiment, the plate applies an absolute pressure of about 30 pounds to the lid. According to any preferred or alternative embodiment, the plate applies a force of about 0 to 1000 psi to the lid when the locking mechanism is in the locked position, preferably less than about 60 psi, more preferably less than about 4 psi, more preferably about 2.5 to 4 psi, more preferably about 2.5 to 3 psi. According to an alternative embodiment, the locking mechanism may include a stop action mechanism to limit the compression of the lid and the container, and to limit potential crushing of the lid and the container.

Figure 2E:
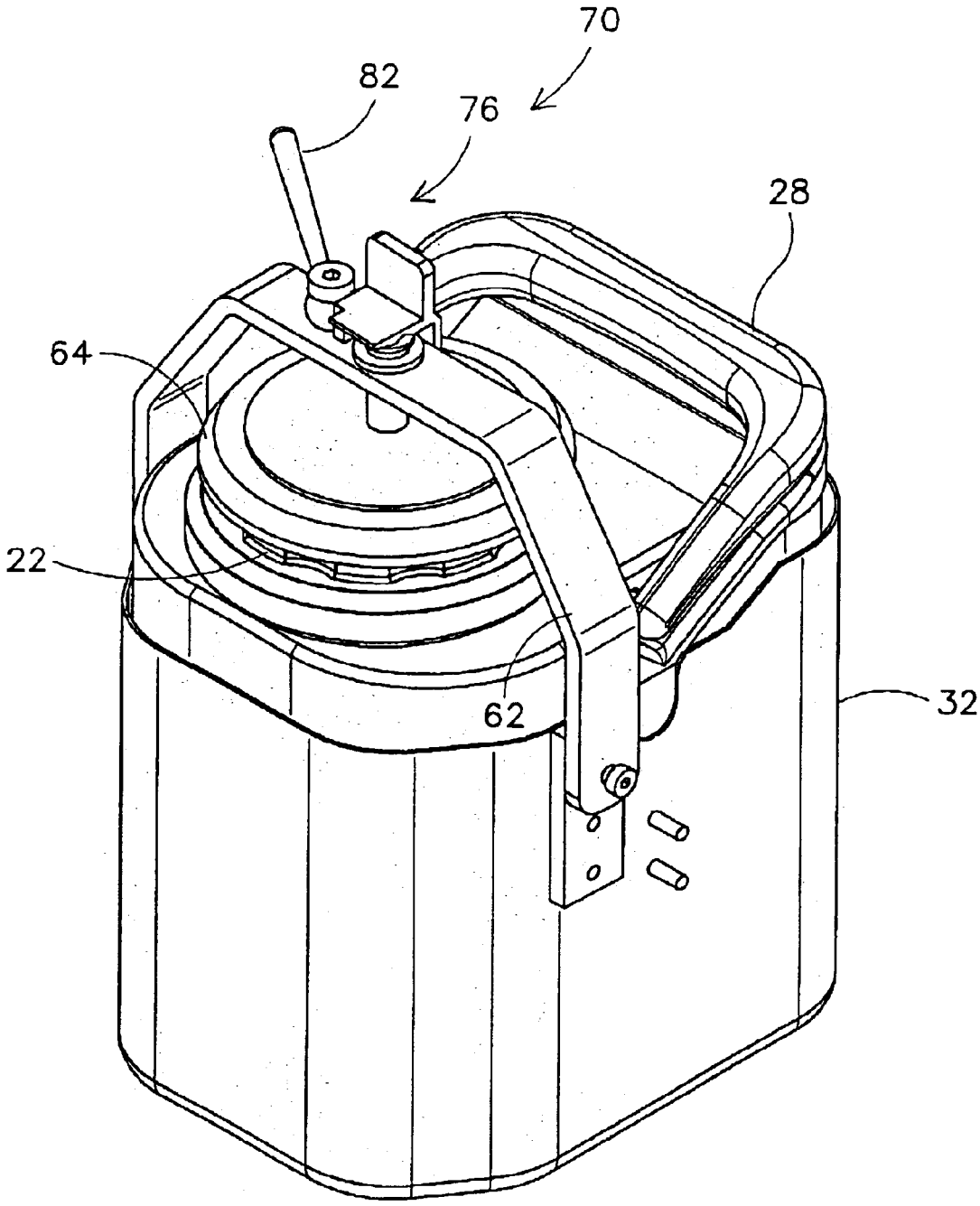

Referring to FIGS. 1 through 2E, container 20 is shown having lid 22 threadably connected to body 24. Container 20 "nests" or fits within holder 32. According to a particularly preferred embodiment, the container has a perimeter that is "D"-shaped, a cross-section that is substantially "D"-shaped, and a substantially flat bottom that is substantially "D"-shaped. The holder has a perimeter that corresponds to the perimeter of the container according to a particularly preferred embodiment (shown as a "D"-shape in FIG. 1 according to a preferred embodiment). According to a particularly preferred embodiment as shown in FIG. 1, container 22 has a volume of about one gallon, and may have other volumes (e.g. one quart) according to other alternative embodiments. According to a particularly preferred embodiment, the lid of the container has an area of about 12.4 square inches. According to a particularly preferred embodiment, the container when filled with paint has a weight of about 8.5 to 12 pounds. The container 20 may include a pour spout 134 according to an alternative embodiment as shown in FIGS. 4A through 4C.

According to a particularly preferred embodiment, the container is of the type disclosed in U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in-part of U.S. patent application Ser. No. 10/006,985 titled "PAINT CONTAINER" filed Dec. 5, 2001, which are hereby incorporated by reference.

Figure 3:
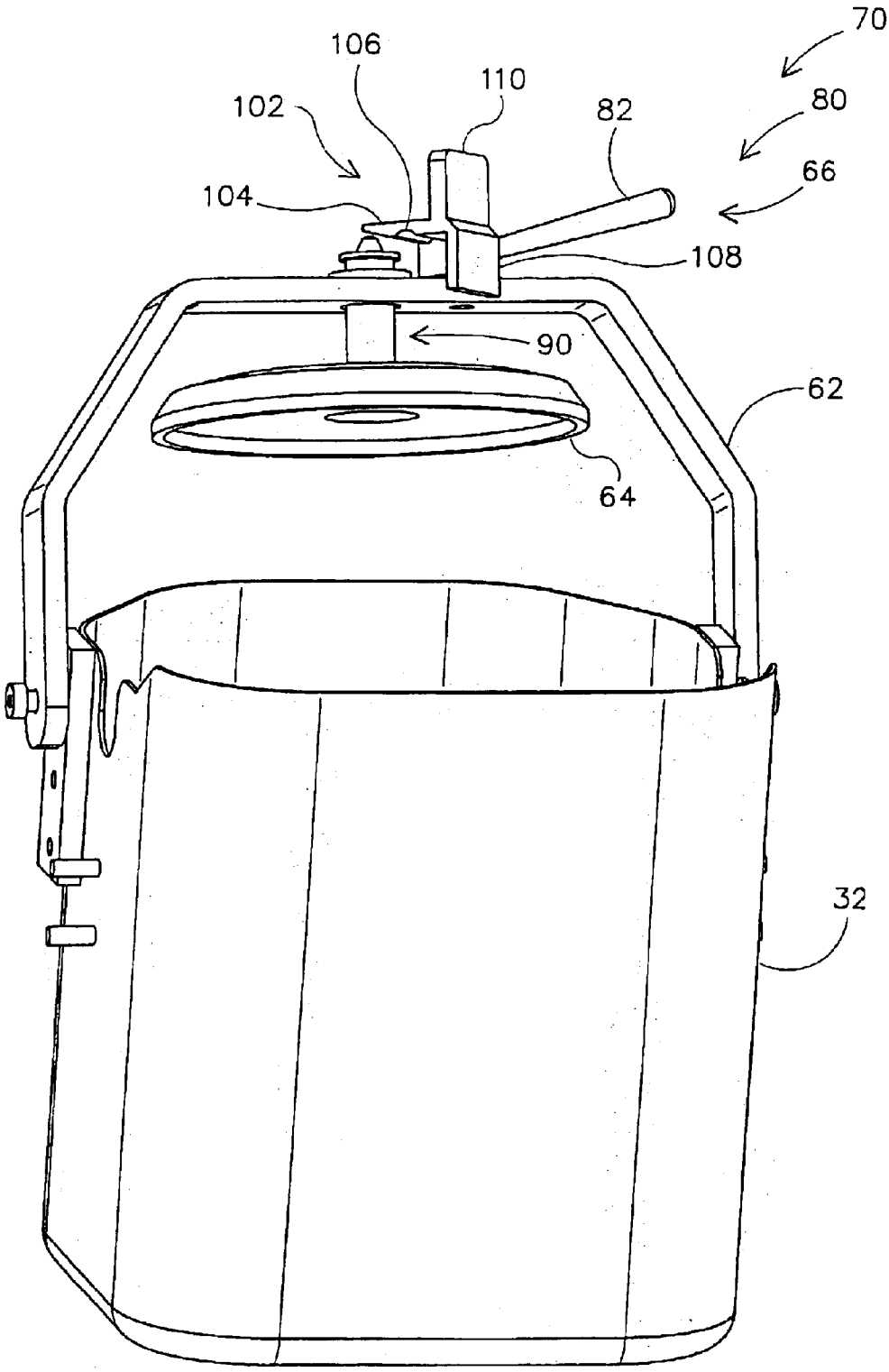
FIG. 3 is a perspective view of a clamp assembly of a paint shaker according to an exemplary embodiment.

Referring to FIG. 3, clamp assembly 60 is shown according to an exemplary embodiment. Clamp assembly 60 acts as a vice to compress lid 22 between plate 64 and base 34 of holder 32. Clamp assembly 60 comprises locking mechanism 70 and a clamping mechanism 66. Clamping mechanism 66 includes plate 64, which moves in a linear direction among unlocked position 72, intermediate position 74 and locked position 76 along vector 122. Plate 64 may be driven or moved (e.g. manually) between unlocked position 72 and intermediate position 74 during loading and unloading of container 20 in holder 32 (see FIG. 2D).

Referring to FIGS. 4A and 4B, locking mechanism 70 includes a handle assembly 80 for pivoting locking mechanism 70 between unlocked position 72 and locked position 76. A follower or handle 82 of handle assembly 80 pivots about a cam or pin 84, which may be "indexed" or notched according to any preferred or alternative embodiment. The turning of handle 82 causes a latching mechanism 100 to turn a latch 102 toward a reciprocating through shaft 90 (see FIGS. 2D and 2E).

Latch 102 includes a ramped or beveled end 104 (see FIG. 3) to engage a plunger 112 having a detent (shown as a ball bearing 114) and a spring 116. When locking mechanism 70 is in locked position 76, a groove 106 of latch 102 engages bearing 114, which maintains the position of latch 102 relative to shaft 90. A locator or stop tab 108 of latch 102 inhibits movement of locking mechanism 70 beyond locked position 76. Latching mechanism 100 also includes a "thumb assist" tab 110 for moving in conjunction with the turning of handle 82.

According to a particularly preferred embodiment, the plunger is a type 316 ball-nose spring plunger having a steel or stainless steel body and a nylon or steel ball, commercially available from McMaster-Carr Supply Company of Chicago, Ill.

Figure 5:
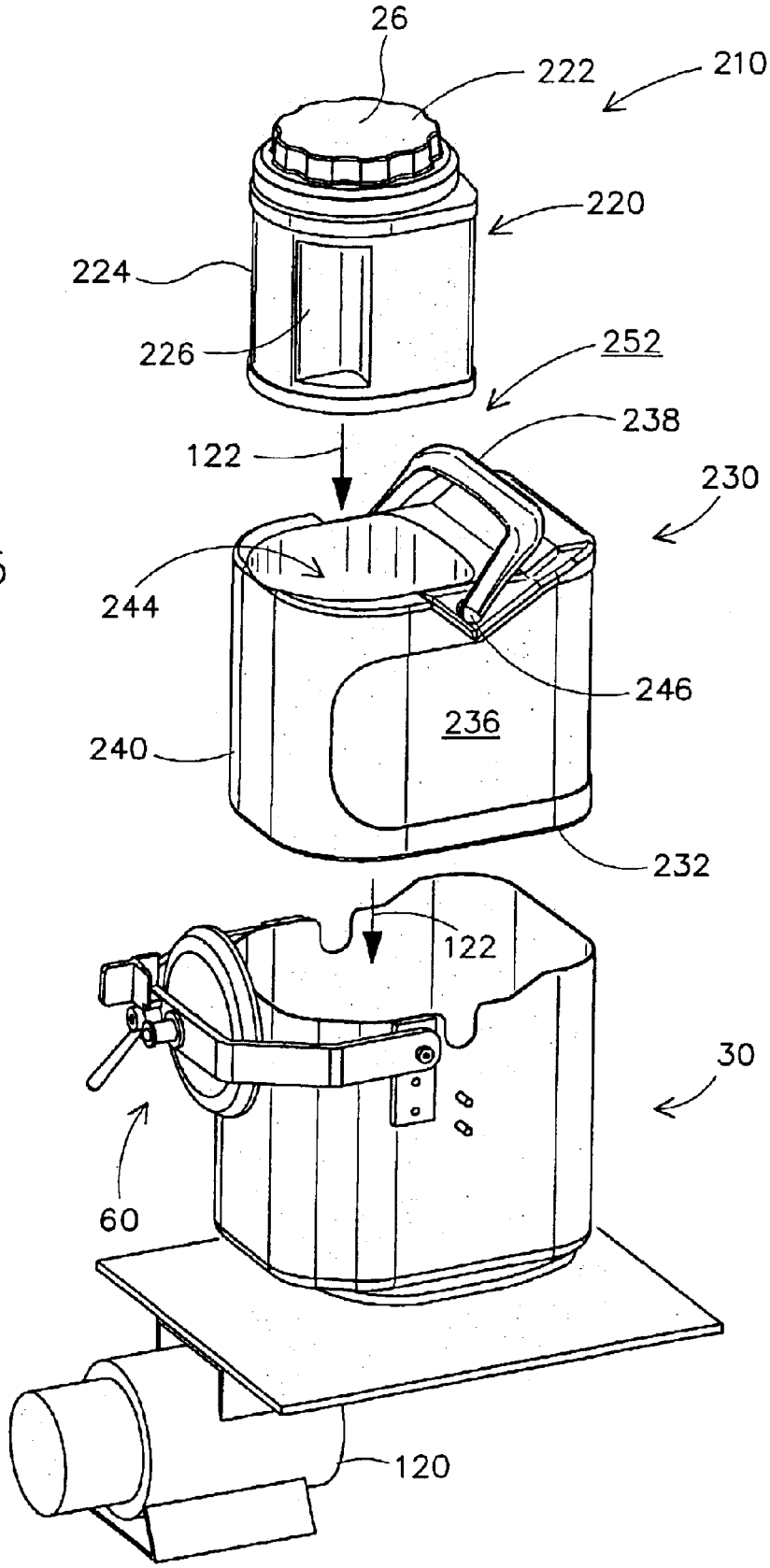
FIG. 5 is an exploded perspective view of a paint shaking system according to an alternative embodiment.

A system for holding a paint container is shown as a system 210 in FIG. 5 according to an alternative embodiment. System 210 is modified from system 10 in at least one substantial respect: a sleeve (shown as an adapter 230) is provided which permits for mixing of different sized paint container 20 and paint container 220 in holder 30. Other than this modification, the construction and performance of system 210 is substantially the same as that of system 10, and like reference numerals are used to identify like elements.

Figure 6A:
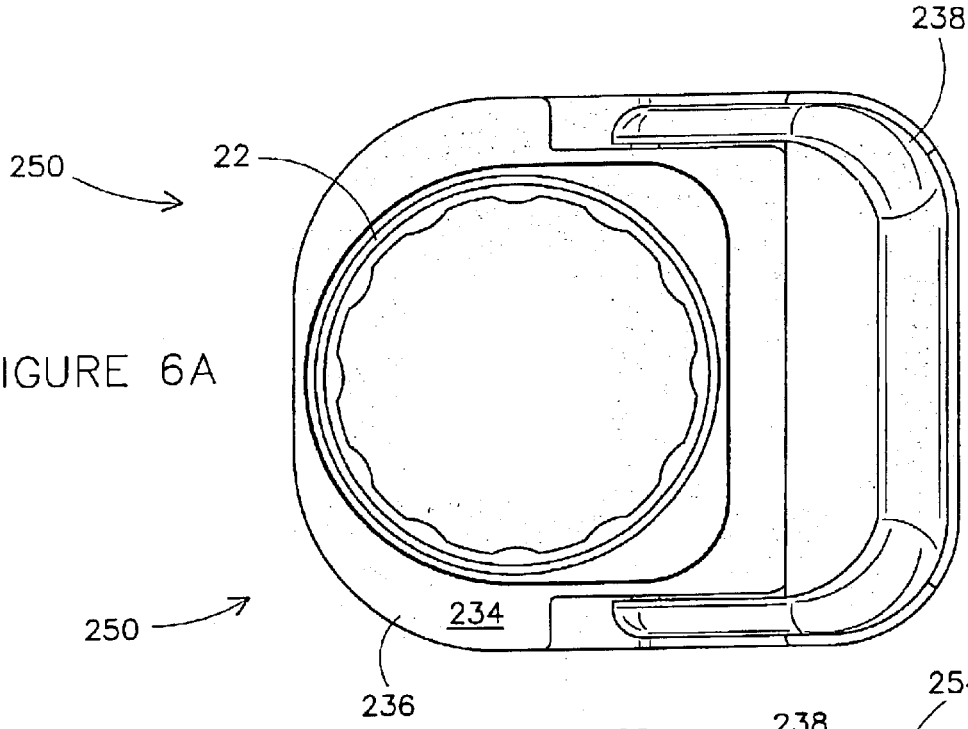
FIG. 6A is a top plan view of an adapter for the paint shaking system of FIG. 5 according to a preferred embodiment.

With container 220 inserted into adapter 230 the combination of container 220 and adapter 230 (shown as an assembly 250 in FIGS. 6A and 6B) resembles container 20 (see FIG. 1). Assembly 250 is inserted into holder 30, which is also configured to receive container 20 (see FIG. 1). Adapter 230 serves at least two functions: (1) it modifies the size of container 220 so that it may fit in holder 30; and (2) it serves as a weight or ballast material to shift the center of gravity to balance assembly 250, to enhance stability of assembly 250 in holder 30, and to provide enhanced mixing of the paint (i.e. the mass of adapter 230 compensates for the mass of paint that would otherwise be provided by container 20).

Referring to FIG. 5, system 210 is shown having paint container 220 (similar to container 20) nested in adapter 230 (e.g. means for supporting the container), which is nested in holder 30. Container 220 includes a lid 222 (the same as lid 22 of FIG. 1) threadably connected to a body 224. A grip (shown as a handle 226) provides for easy manipulation by a user.

According to a particularly preferred embodiment as shown in FIG. 5, container 220 has a perimeter that is "D"-shaped, a cross-section that is substantially "D"-shaped, and a bottom that is substantially "D"-shaped. According to a particularly preferred embodiment as shown in FIG. 5, container 220 has a volume of about one-quart, and may have other volumes according to other alternative embodiments. According to a particularly preferred embodiment, the container when filled with paint has a weight of about two to three pounds. According to a particularly preferred embodiment, the container is of the type disclosed U.S. Design patent application No. 29/164,453 titled "CONTAINER" filed Jul. 24, 2002, which is hereby incorporated by reference.

Figure 6B:
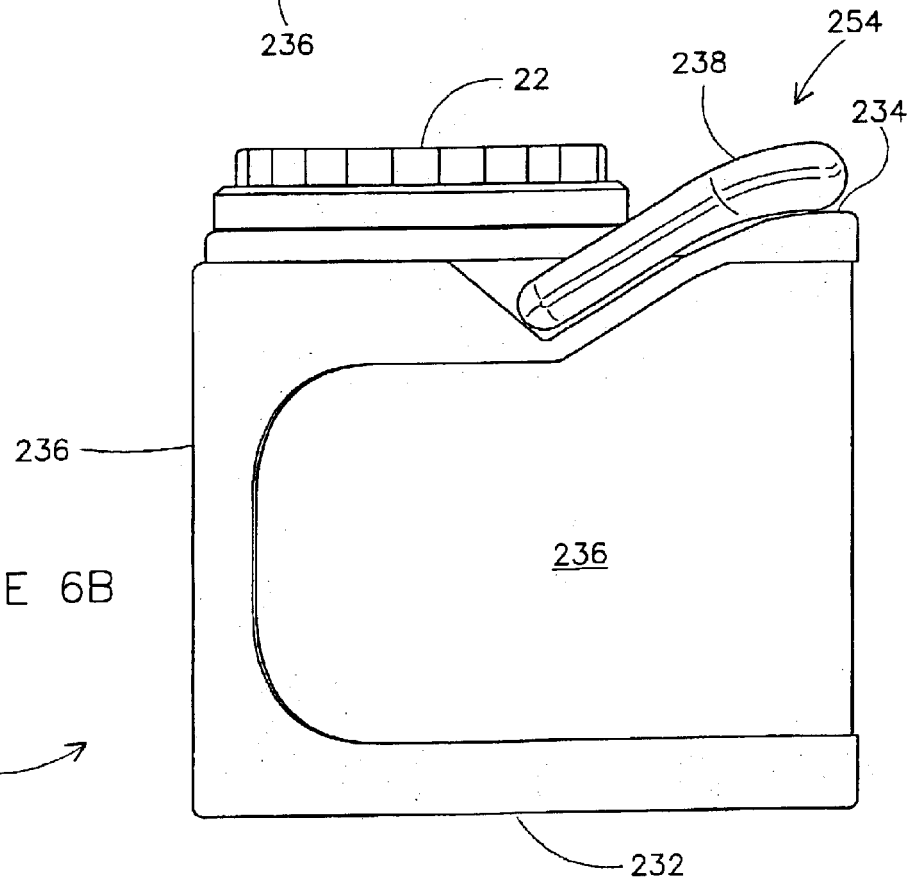
FIG. 6B is a side elevation view of the adapter for the paint shaking system of FIG. 5 with a paint container of FIG. 5 according to a preferred embodiment.
Figure 7:
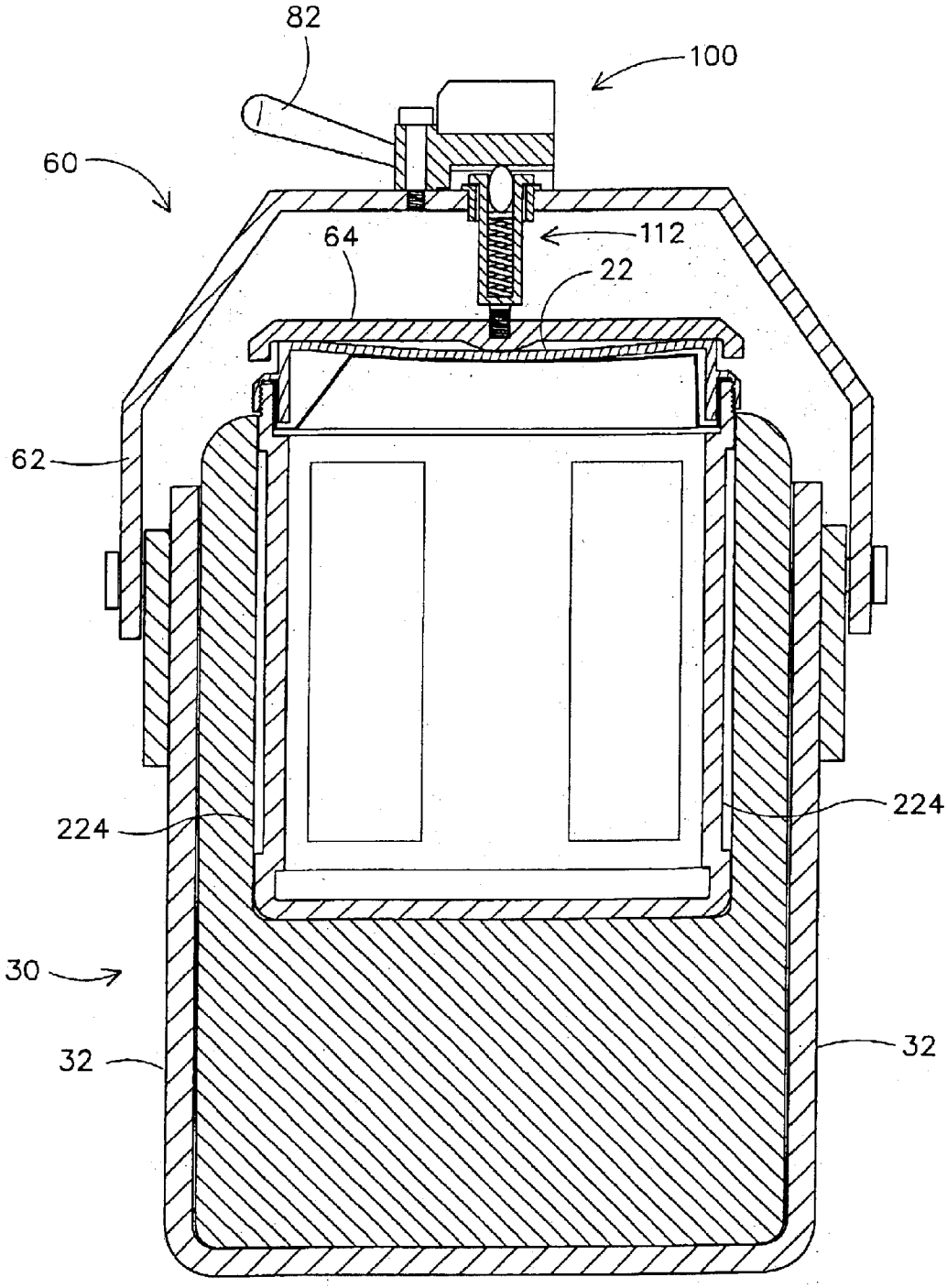
FIG. 7 is a sectional view of the paint shaker system of FIG. 5 according to an exemplary embodiment.

Referring further to FIG. 5, a body 240 of adapter 230 has a side wall 236 extending from a base 232 to a cover 234. A bail or handle 238 extends from the top of side wall 236. Handle 238 is selectively configurable about a pivot or hinge 246 between an upright or use position 252 (see FIG. 7) and a horizontal or storage position 254 (see FIG. 6B). Handle 238 in use position 252 assists in insertion of adapter 230 (and/or assembly 250) along vector 122 into holder 30. When handle 238 is in storage position 254, the top of lid 22 of container 220 is substantially level with the top of handle 238 as shown in FIG. 6B according to a preferred embodiment.

Referring further to FIG. 5, an orifice or aperture provides access to a cavity 244 of body 240 from an overhead position along vector 122. Cavity 244 (e.g. means for accessing the adapter) has a perimeter that corresponds to the perimeter of container 220 according to a preferred embodiment. The perimeter of cavity 244 is substantially "D"-shaped as shown in FIG. 5 according to a preferred embodiment.

Cavity 244 is surrounded by base 232 and side wall 236 of body 240. The body of the adapter is a rigid, solid material (such as a polyester resin or fiberglass reinforced polyester resin) according to a preferred embodiment. The body of the adapter may be a different material such as polyurethane to simulate the mass of the paint according to other alternative embodiments. According to another alternative embodiment, the body may by a hollow member having weights or counterbalances strategically placed to shift the same center of gravity of the assembly. The body may be a flexible or relatively soft material that is somewhat resilient (such as an acrylic foam) to assist in removal of the container from the cavity according to an alternative embodiment.

The density of the body of the adapter corresponds to the density of the container of paint intended for insertion into the adapter according to a preferred embodiment (e.g. the density of the body is substantially the same as the density of the container of paint). According to an alternative embodiment, the weight distribution and center of gravity of the combination of the (smaller, e.g. one quart) container and the adapter is the same as the weight distribution and center of gravity of the (larger, e.g. one gallon) container. Without intending to be limited to any particular theory, it is believed that controlling the density and/or weight distribution of the body of the adapter assists in shifting the center of gravity of the assembly (i.e. combination of the adapter and the container) to balance the assembly, enhance stability of the assembly in the holder, and to provide enhanced mixing of the paint.

The weight of the body of the adapter is selected to compensate for the mass of paint that would otherwise be provided by the container shown in FIG. 1 according to a preferred embodiment. According to a suitable embodiment, the adapter has a weight of about 8 to 12 pounds (e.g. notwithstanding the weight of the container of paint configured for insertion into the adapter), suitably about 9.5 pounds. According to a suitable embodiment, the adapter has a density of about 8 pounds per gallon to about 12 pounds per gallon.

Referring to FIGS. 1 and 5, holder 30 may be used with containers 20 and 220 of different volumes according to the following exemplary method. Referring to FIG. 1, clamp assembly 60 is moved to retracted position 52. Container 20 is placed in holder 30. Clamp assembly 60 is advanced to use position 56. Plate 64 is lowered to intermediate position 74. Handle 82 is pivoted to move plate 64 into locked position 76. The paint shaker (with motor 120) is optionally balanced. Holder 30 is mixed with the paint shaker.

Referring to FIG. 5, container 220 is placed in adapter 230. Clamp assembly 60 is moved to retracted position 52. Assembly 250 of container 220 and adapter 230 is placed into holder 30. Clamp assembly 60 is moved to use position 56. Plate 64 is lowered to intermediate position 74. Handle 82 is pivoted to move plate 64 into locked position 76. The paint shaker (with motor 120) is optionally balanced. Holder 30 is mixed with the paint shaker.

It is important to note that the construction and arrangement of the elements of the system for holding paint container as shown in the preferred and other exemplary embodiments is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present invention as expressed in the appended claims.

What is claimed is:

1. A holder for mixing a container of paint comprising:

a body having a cover and a base;

an aperture in the cover of the body;

a cavity in the body and accessible through the aperture and configured to receive the container;

wherein the density of the body corresponds to the density of the container of paint.

2. The holder of claim 1 wherein the density of the body is substantially the same as the density of the container of paint.

3. The holder of claim 1 wherein the body is substantially solid.

4. The holder of claim 3 wherein the weight of the body is in the range of about 8 to 12 pounds.

5. The holder of claim 4 wherein the body comprises a polyester resin.

6. The holder of claim 5 wherein the resin is reinforced with glass.

7. The holder of claim 3 wherein the body comprises a resilient material.

8. The holder of claim 7 wherein the body comprises a foam.

9. The holder of claim 3 wherein the aperture is situated away from a central vertical axis of the body.

10. The holder of claim 3 wherein the aperture is off-center from a central vertical axis of the body.

11. The holder of claim 10 wherein a perimeter of the aperture is less than a perimeter of the cover.

12. The holder of claim 10 wherein the base of the body is configured for rotation about at least one axis to mix the contents of the container.

13. The holder of claim 12 further comprising a handle coupled to the body and selectively configurable between a use position and a storage position.

14. The holder of claim 13 wherein when the container is received within the body, the lid of the container is substantially level with the handle in the storage position.

15. The holder of claim 14 wherein a cross-section of the body is substantially "D"-shaped.

16. The holder of claim 15 wherein a volume of the cavity is less than or equal to about one quart.

17. The holder of claim 13 wherein a volume of body is less than or equal to about one gallon.

18. The holder of claim 12 wherein a cross-section of the body is substantially the same as a cross-section of the container.

19. A system for holding and mixing a container of paint having a lid secured to a first body comprising:

a holder comprising a clamp having a plate configured to apply pressure to the lid of the container;

a motor configured to move the holder about at least one axis;

an adapter comprising a second body configured to nest in the holder and a cavity in the second body configured to receive the container;

an aperture in the adapter positioned off-center from a central vertical axis of the second body;

wherein the density of the adapter corresponds to the density of the container of paint.

20. The system of claim 19 wherein the adapter comprises a sleeve.

21. The system of claim 19 wherein the cavity is positioned off-center from a central vertical axis of the second body.

22. The system of claim 21 wherein a cross-section of the adapter is substantially "D"-shaped.

23. The system of claim 21 wherein a cross-section of the adapter is substantially the same as a cross-section of the container.

24. A system for holding and mixing a first container of paint having a first volume and a second container of paint having a second volume less than the first volume comprising:

a holder configured to hold the first container;

an adapter configured for being removably placed within the holder and being configured to support the second container;

wherein the adapter has substantially the same mass distribution as the first container.

25. The system of claim 24 wherein the second container supported by the adapter and placed in the holder has substantially the same weight distribution as the first container.

26. The system of claim 25 further comprising a mixer configured to move the holder about at least one axis.

27. The system of claim 26 wherein the mixer is balanced for both the first container and the second container supported by the adapter placed in the holder.

28. The system of claim 24 wherein the second container supported by the adapter and placed in the holder has substantially the same center of gravity as the first container.

29. The system of claim 24 wherein the density of the adapter corresponds to the density of the first container of paint.

* * * * *